United States Patent [19]

Weber

[11] 3,954,262

[45] May 4, 1976

[54] GAME DEVICE

[75] Inventor: Leonard J. Weber, Broadview, Ill.

[73] Assignees: Ronald J. LaPointe; Richard Lee Caldwell, ; part interest to each

[22] Filed: July 14, 1975

[21] Appl. No.: 595,599

[52] U.S. Cl. ..... 273/1 E; 58/1 R; 58/145 D; 273/147

[51] Int. Cl.[2] ..... A63F 9/16

[58] Field of Search ..... 273/1 E, 1 R, 138 A, 273/147, DIG. 25, 86 R, 86 B; 58/1 R, 145

[56] References Cited

UNITED STATES PATENTS

| | | | |
|---|---|---|---|
| 3,036,834 | 5/1962 | Zalkind | 273/DIG. 25 |
| 3,565,440 | 2/1971 | Glass et al. | 273/1 R X |
| 3,583,701 | 6/1971 | Glass et al. | 273/1 R |
| 3,602,503 | 8/1971 | Schwartz et al. | 273/1 E |
| 3,612,527 | 10/1971 | Rogerson | 273/1 R X |

FOREIGN PATENTS OR APPLICATIONS

| | | | |
|---|---|---|---|
| 127,197 | 5/1919 | United Kingdom | 273/157 R |

*Primary Examiner*—Paul E. Shapiro
*Attorney, Agent, or Firm*—Hill, Gross, Simpson, Van Santen, Steadman, Chiara & Simpson

[57] ABSTRACT

A game device including a game board of a substantially annular configuration with a depositary or hopper at its center for containing play pieces and a plurality of recesses and holes in that portion of the game board surrounding the depositary, these recesses and holes being adapted to receive the play pieces of various colors, and further including a pair of electrically conductive metal rings surrounding said depositary, said metal rings being disposed in angular relation with respect to each other to define a circular trough-like structure in which a top is adapted to be spun, said rings being separated from each other by an insulating section, and connected into an electrical circuit and said top, when toppled from its spinning position to a position in contact with both metal rings being effective to complete the electrical circuit to signal the end of play of the game.

15 Claims, 6 Drawing Figures

GAME DEVICE

This invention relates to a game device and, more paritcularly, to a device which utilizes a game board and a spinning top to measure the time during which play pieces may be appropriately matched with corresponding means on the game board.

SUMMARY OF THE INVENTION

It is an object of the present invention to provide a game device of a substantially circular configuration divided into a plurality of arcuate segments surrounding a depositary or hopper from which the play pieces are removed during the process of the game, each segment containing play piece receiving means.

It is another object of this invention to provide in a game device a track of a pair of annularly spaced conducting members or rings connected into an electrical circuit and an associated metal top which is adapted to be spun between said conducting members and further adapted when it ceases spinning and topples, to lie across said conducting members to complete an electrical circuit to thereby activate a means indicating that the player must stop play.

A still further object of the invention is to provide in a game device a depositary or hopper for play pieces including a trap door which opens in response to a toppled top which has completed an electrical circuit, said released trap door being effective to release the play pieces from a player's reach to effectively stop play.

Another object of the invention is to provide timer means in conjunction with a game device whereby remaining top spinning time may be measured when all of the play pieces have been placed in their appropriate receiving means.

Another object of the invention is to provide in a game structure means for putting the play pieces beyond the reach of the operator when the top being used in the game has stopped spinning.

Another object of the invention is to provide a game involving skill and dexterity in matching certain play pieces with other means on the game board and wherein the time element for performing this matching function is governed by the length of spin of a top which has been spun by a game participant, time of spinning of which itself is determined by the participant's skill.

The invention herein includes a game board which may be of a generally annular configuration and having a depositary or hopper at its center for containing play pieces which may include colored spheres and/or pegs and/or rings. The game board is divided into several different color coded arcuate segments, preferably five, disposed adjacent each other in circular array and surrounding the depositary. Each segment has formed therein an equal number of pockets or recesses for receiving the colored spheres and holes for receiving pegs, around which rings may be placed. The device is provided with a track having two concentrically disposed metal rings disposed on the upper surface of the game board and canted toward each other. The two concentric rings are separated from each other by insulating material. A disk-type top is spun by hand in the small insulated area between the two rings and when the top reaches the end of its spin and falls on its disk edge the latter bridges the distance between the two rings and contacts the two rings closing an electrical circuit, which then functions to allow a trap door at the bottom of the receptacle or hopper to open and dump all of the remaining spheres, pegs and rings into a container disposed beneath the hopper. While the top is spinning a player removes as many as possible of the colored spheres and/or pegs and/or rings from the center receptacle or hopper and places each in a recess or hole of a complementary color matching segment.

Other objects and advantages of this invention will become more apparent from the following description when considered in conjunction with the accompanying drawings.

DESCRIPTION OF PREFERRED EMBODIMENTS

The game disclosed herein is a game of skill involving the spinning of a top with the fingers of either hand in a confined area or track. The object of the game is to see how many play pieces, which may be balls, pins or rings or combinations thereof, can be removed from a receptacle or hopper, and then placed into any one of 100 holes around the outside of the spinning area during the time that the top is spinning. In the embodiment disclosed herein the hopper is inside of the spinning area. A ball or sphere is placed in a hole and if pins are used then a ring can be placed over a pin. If pins and rings are used, then this would entail 200 operations. 300 individual parts may be used including a complete set of balls, 20 red, 20 green, 20 yellow, 20 blue, and 20 black, 20 pins of each of the five colors, and also 100 rings of the same five colors. If balls, pins, rings or pins and rings are in the hopper at the same time the top stops spinning, then an electrical circuit is completed to operate an electrical circuit which in one embodiment includes a solenoid which trips a latch to open the bottom of the hopper to dump the remaining parts into a container placed below the game board, thus effectively halting continuation of play by the player. Generally speaking, in the disclosed embodiment five equal arcuate sections of 72° each and having holes in each section are provided. These sections are color coded with one of each of the five different colors. It is optional to play by color or at random. It is also optional to play using the balls, rings or pins alone or using pins and rings combined as well as using balls and rings, if desired. A good spin or a long spin does not necessarily guarantee a player a high score. Obviously a short spin of the top with a fast placing of balls, pins or rings into the holes may result in a better score than a long spin and slow placing of the play pieces in the proper places. The whole purpose of the game is to place the greatest number of parts into the receiving positions while the top is spinning. A score of 200 with balls and rings or pins and rings with 20 of each of the proper corresponding color in each of the five sections while the top spins would be the best a player can do. If the top is still spinning after all the pieces have been removed from the hopper, the additional time the top spins may be computed by a stopwatch or timer to add to the score.

Figure 1:
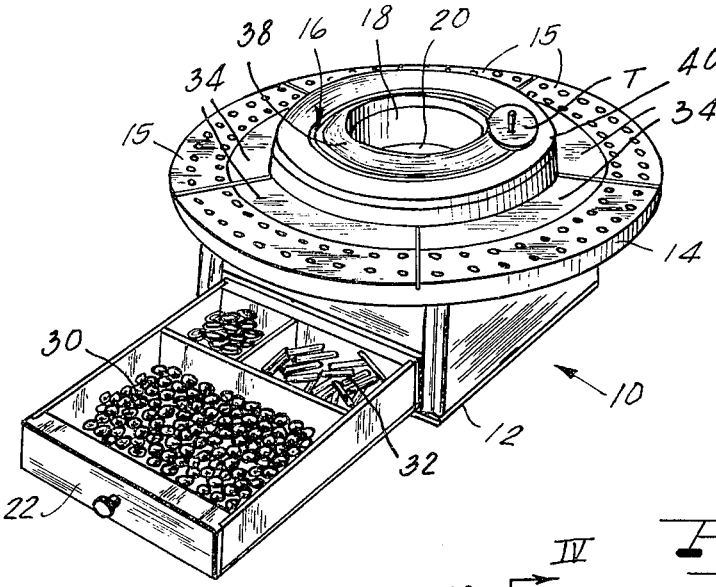
FIG. 1 is a perspective view of the game device made in accordance with the invention herein.
Figure 2:
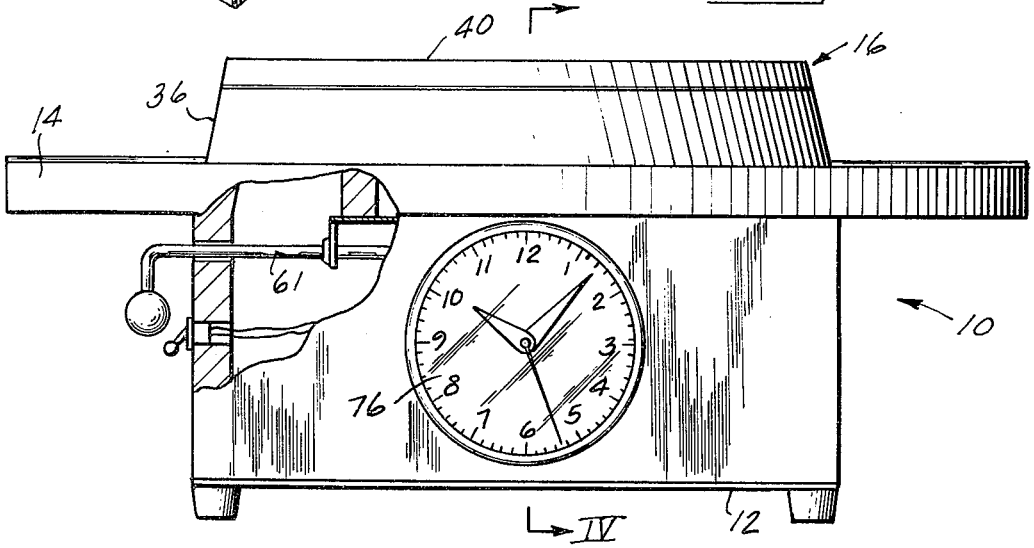
FIG. 2 is a view in elevation of the game device of FIG. 1.
Figure 3:
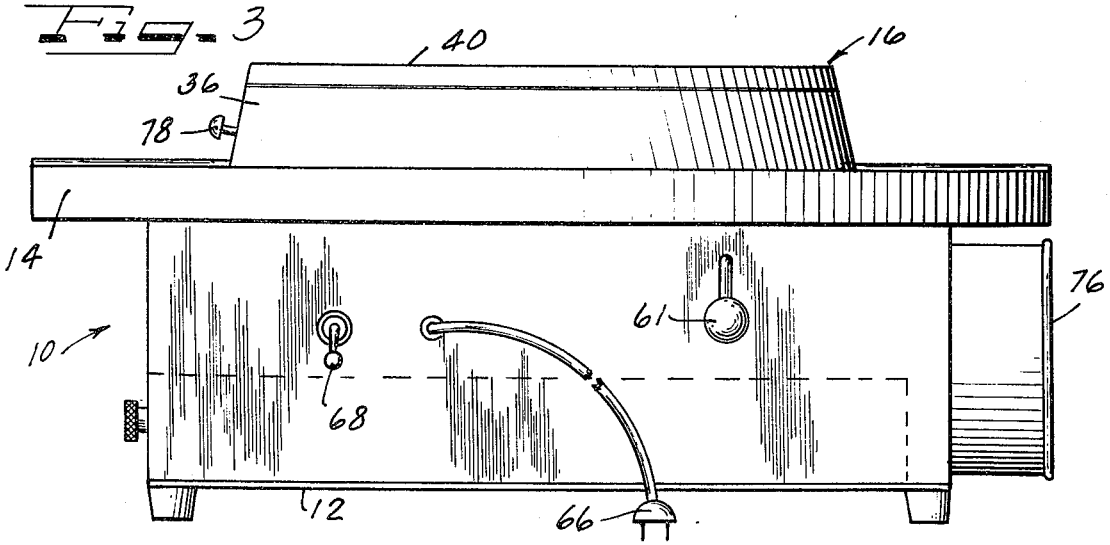
FIG. 3 is a side view in elevation of the game device of FIG. 1.

Referring now to the drawings wherein like reference characters in the several views designate similar parts, a game device 10 embodying the invention herein is shown in perspective view in FIG. 1. The game device 10 includes a box-like base 12, a circular table 14, a top spinning track 16, a centrally disposed depositary, hopper or receptacle 18, a releasable trap door 20 associated with the lower end of the hopper 18 and a storage drawer 22 slidably disposed in the base 12.

The box-like base 12 may be substantially square and may be made of wood or plastic, for example. The base 12 defines a housing and includes a cavity 24 in the lower part of which the drawer 22 is disposed and in the upper portion of which may be positioned the necessary electrical parts and mechanical parts used in conjunction with operating the trap door 20. The base and circular table attached thereto could also be made of light stamped metal parts.

The substantially circular table 14 may be formed integral with the base 12 and is divided on its upper surface into a plurality of equal sized arcuate segments 15, here shown as and preferably being five in number. In each of these segments an equal number of recesses 26 and coaxially disposed pin holes 28 are formed, each of which are adapted to receive play pieces which during the game are removed one by one from the depositary 18. The recesses are adapted to receive spheres 30 and the pin holes are adapted to receive pins 32. Radially inwardly of the recesses 26, areas 34 are each colored different colors for each of the segments to indicate the color of the spheres and pins that are to be placed in the recesses and pin holes of that particular segment.

Figure 4:
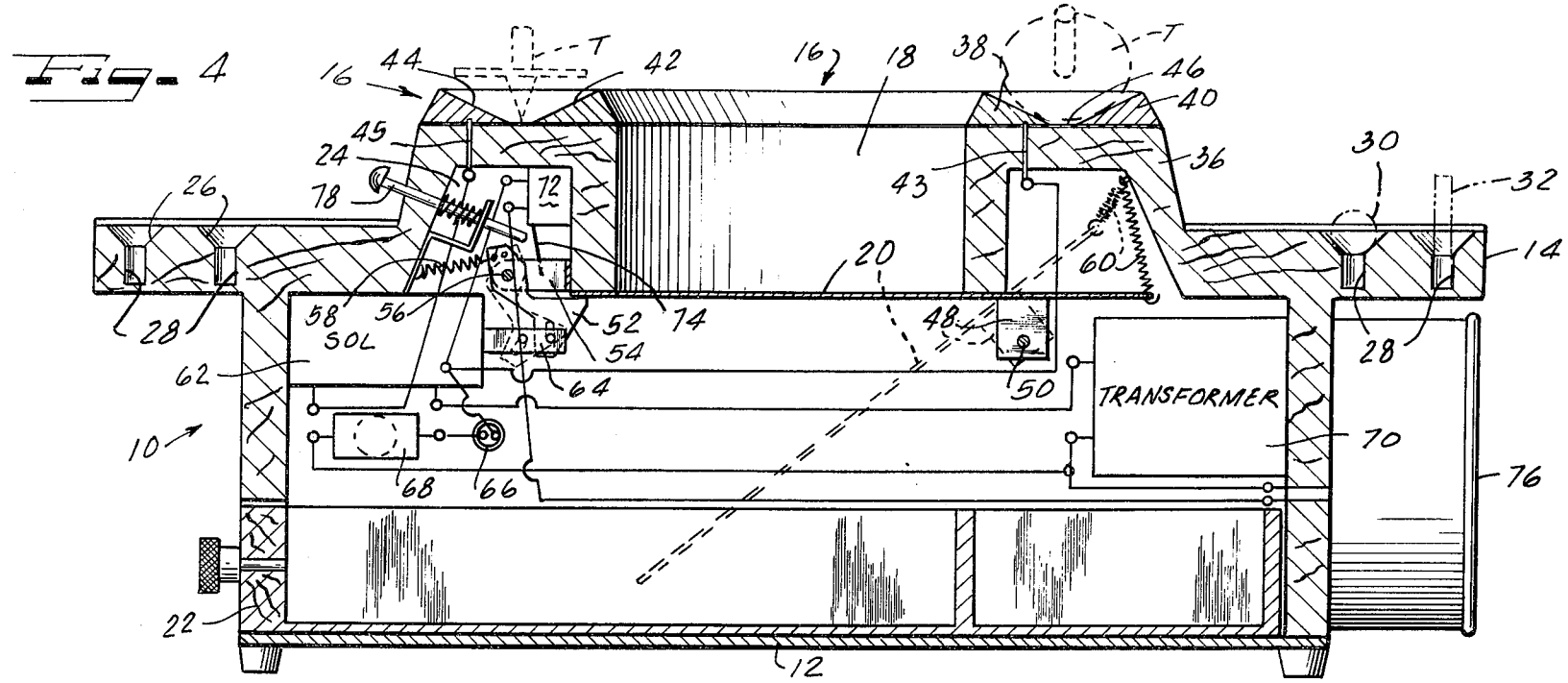
FIG. 4 is a sectional view in elevation of the game device of FIG. 1 taken along line IV—IV of FIG. 2.
Figure 6:
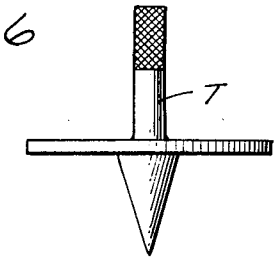
FIG. 6 is an elevation view of a top of the type which may be used with the disclosed game board.

The top spinning track 16 is formed on the upper surface of a raised ledge 36 which may be part of the table 14. The track 16 comprises a pair of concentrically disposed inner and outer electrically conductive metal rings 38 and 40 formed respectively with downwardly canted surfaces 42 and 44, thus forming a generally circular troughlike structure. The rings are radailly spaced from each other by a flat insulating surface 46 upon which a top T is adapted to spin, as seen in FIG. 4. Leads 43 and 45 connected to the inner and outer rings respectively are provided to connect the rings into the electrical circuitry.

The centrally disposed depositary or hopper 18 is designed to contain a number of spheres, pins and rings which are used in the game and which are selectively picked out of the hopper by a game participant to be placed in a matching color segment. The hopper 18 preferably is of a cylindrical shape being located coaxially with the track 16.

The trap door 20 normally closing the lower end of the hopper 18 is pivotally mounted by means of a bracket 48 on the pivot pin 50 and is held in the closed position by a pivotally mounted latch 52. The latch 52 is mounted on the bracket 54 by means of pivot pin 56 and is urged to a latching position by means of the spring 58. Releasing of the latch 52 permits the spring 60 to urge the trap door 20 to an open position. Other means such as a weight attached to the trap door could be used to urge it to an open position. A low voltage solenoid 62 having an arm 64 when actuated is effective to retract the arm 64 which is connected to the latch 52 to thereby release the latch 52. A lever 61 is connected to the trap door to manually restore it to a closed position.

The device 10 is connectable to an electrical power source such as a common 110-volt line through the plug 66 through an on-off switch 68 and through a transformer 70 to reduce the voltage for safety purposes to the low voltage solenoid 62. When the switch 68 is in the "on" position the solenoid 62 is activated by the closing of the electrical circuit between the inner and outer rings 38 and 40 when the spinning top stops and comes to rest and contacts both inner and outer rings. Appropriate electrical leads interconnect the transformer 70, switch 68 and solenoid 62. As an alternative the electrical power may be supplied by battery means incorporated within the unit.

As an added feature a microswitch 72 may be connected into the electrical circuitry and positioned in the upper portion of the cavity 24. The microswitch which is normally open is equipped with an operating arm 74 which is adapted to be actuated by the upper end of the latch 52 when the latter is swung to a position for releasing the trap door 20 by the solenoid 62. The microswitch 72 is connected to a timer 76 and actuation of the operating arm 74 by the latch 52 or by a hand operated spring biased plunger 78 which extends through the housing is effective to start the timer running. The timer may be used, for example, to measure the length of time the top continues to run after all of the objects have been removed from the hopper. In the alternative, of course, a stop watch or other independent timing means could be used to measure this amount of time.

In operation the hopper 18 may be filled, for example, with 100 balls or spheres of the five different colors. Then the top T is spun on the track 16 and commencing with the beginning of the spinning of the top, play pieces are removed from the hopper 18 and placed in recesses associated with the corresponding appropriate color coded segments 15 (within their matching color area). This process of placing the play pieces in the recesses or pin holes in continued until the top stops spinning. When the top stops spinning it comes to rest across the two inner and outer rings 38 and 40 to complete an electrical circuit through the solenoid 62 which releases the latch 52 to permit the trap door 20 to be urged to a dumping position by the spring 60. This causes the remaining play pieces in the hopper to be dumped through the cavity 24 into the drawer 22 disposed in the lower part of the base section out of reach of the player and automatically stopping play.

In the event that a player is successful in placing all of the play pieces into the recesses before the spinning top stops spinning, the plunger 78 may be pressed to start the timer to determine how long the top spins after all the play pieces are placed in their appropriate positions. In the alternative, a stop watch could be used for this purpose.

Figure 5:
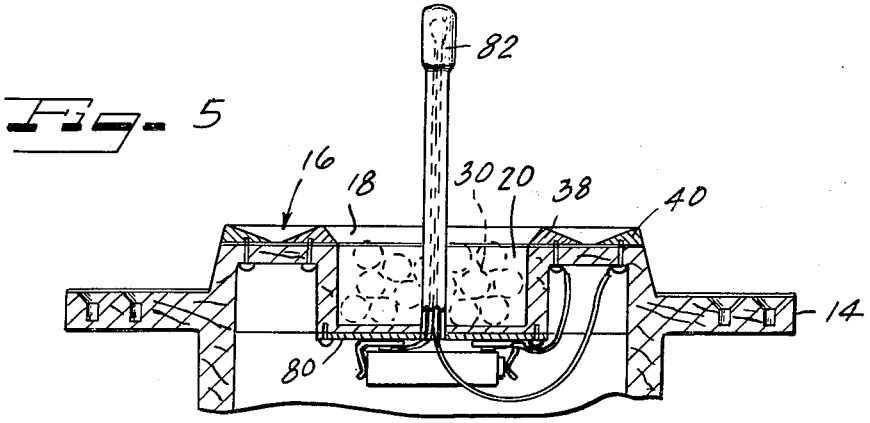
FIG. 5 is a partial sectional view in elevation of a modified embodiment of the game device.

In an alternative embodiment as shown in FIG. 5, the hopper may be arranged with a permanently closed bottom in the nature of a plate member 80. In such a construction instead of the automatic discontinuance of play caused by the opening of a trap door releasing the play pieces other indicating means may be provided to indicate the stoppage of play. For example, an electrical circuit may be provided in the device which includes a buzzer, or bell or light means 82 which is activated in the same manner as previously described, namely, by the spinning top coming to rest across the inner and outer rings 38 and 40.

While preferred embodiments of the invention have been disclosed it will be appreciated that these have been shown by way of example only, and the invention is not to be limited thereto as other variations will be apparent to those skilled in the art and the invention is to be given its fullest possible interpretation within the terms of the following claims.

What is claimed is:

1. A game device comprising:

a housing;

a game board disposed on top of said housing and including a plurality of recesses for receiving play pieces therein;

a pair of radially spaced, concentric metal electrically conducting ring members;

insulating means disposed between said metal ring members for insulating said electrically conducting ring members from each other;

a hopper for containing play pieces disposed at the center of said game board;

a trap door disposed at the bottom of said hopper closing the bottom end thereof;

means for releasing said trap door from its hopper closing position;

electrical circuit means disposed in said housing for operating said trap door and adapted to be connected to an electrical power source and said electrical circuit means being connected to said pair of metal rings and to said trap door releasing means;

said electrical circuit means being adapted to be closed by placing a conductor across said two metal ring members.

2. The game device of claim 1 wherein said means for releasing said trap door from its hopper closing position includes latch means mounted in said housing and solenoid means operatively connected to said latch means for actuating said latch means.

3. The game device of claim 2 wherein said solenoid is a low voltage solenoid and further including a transformer for reducing the voltage to the solenoid.

4. The game device of claim 3 including a microswitch and a timer device connected in said electrical circuit means, said microswitch being adapted to be actuated by the opening of said latch means and effective to control said timer.

5. The game device of claim 1 wherein said game board is an annular board divided into a plurality of segments, each of said segments having a portion of said recesses therein for receiving play pieces.

6. The game device of claim 1 including a receptacle in said housing disposed beneath said hopper for receiving play pieces when said trap door is opened.

7. The game device of claim 1 wherein said metal ring members are canted toward each other to provide a trough-like structure.

8. The game device of claim 1 wherein said game board is an annular board divided into a plurality of segments each of said segment having a portion of said recesses therein for receiving play pieces; and said metal ring members are canted inwardly toward each other to provide a trough-like structure adapted to confine the movement of a spinning top used in the game.

9. The game device of claim 1 including spring means for urging said trap door to an open position.

10. The game device of claim 9 including lever means connected to said trap door for moving said trap door back to a closed position.

11. The game device of claim 1 wherein the means for closing said electrical circuit means comprises a top which is spun between the two concentric metal ring members and when it falls from its spinning position, spans the distance between and contacts each of said two metal rings.

12. A game device comprising:

a housing;

a game board disposed on top of said housing and including a plurality of recesses for receiving play pieces therein;

a pair of radially spaced, concentrically disposed, metal, electrically conducting rings;

insulating means disposed between said rings for insulating said electrically conducting rings from each other;

a hopper for containing play pieces disposed at the center of said game board;

electrically actuated indicating means operatively associated with said game device for indicating the end of play;

electrical circuitry disposed in said housing and adapted to be connected to an electrical power source and said electrical circuitry being connected to said pair of spaced metal rings and said indicating means, said electrical circuitry being adapted to activate said indicating means when the electrical circuit is closed by placing a conductor across said two metal rings.

13. The game device of claim 12 wherein said indicating means is a light.

14. The game device of claim 12 including a metal top which is the conductor to be placed across said two metal rings.

15. A game device comprising:

a game board including a plurality of recesses for receiving play pieces therein;

a pair of slightly spaced metal electrically conducting members having upper surfaces which are canted downwardly toward each other to define a trough-like structure;

insulating means disposed between said metal members, and defining the bottom of said trough-like structure for insulating said metal members from each other;

a hopper for containing play pieces formed in said game board;

electrically actuated indicating means operatively associated with said game device for indicating the end of play;

electrical circuitry associated with said game board and adapted to be connected to an electrical power source and said electrical circuitry being connected to said pair of metal members and said indicating means, said electrical circuitry being adapted to activate said indicating means when the electrical circuit is closed by placing a conductor across said pair of metal members.

* * * * *